United States Patent [19]

Stuchberry et al.

[11] 4,035,282

[45] July 12, 1977

[54] PROCESS FOR RECOVERY OF BITUMEN FROM A BITUMINOUS FROTH

[75] Inventors: Frederick C. Stuchberry; Alfred E. Backstrom, both of Calgary, Canada

[73] Assignees: Shell Canada Limited, Toronto, Canada; Shell Explorer Limited, Houston, Tex.

[21] Appl. No.: 606,158

[22] Filed: Aug. 20, 1975

[51] Int. Cl.[2] ..... C10G 1/04
[52] U.S. Cl. ..... 208/11 LE
[58] Field of Search ..... 208/11 LE

[56] References Cited

U.S. PATENT DOCUMENTS

| | | | |
|---|---|---|---|
| 3,607,721 | 9/1971 | Nagy | 208/11 LE |
| 3,808,120 | 4/1974 | Smith | 208/11 LE |
| 3,884,829 | 5/1975 | Moyer | 208/11 LE |

FOREIGN PATENT DOCUMENTS

| | | | |
|---|---|---|---|
| 918,091 | 1/1973 | Canada | 208/11 LE |

*Primary Examiner*—Delbert E. Gantz
*Assistant Examiner*—James W. Hellwege

[57] ABSTRACT

An improved method for recovery of bitumen form bituminous froth is disclosed having particular application in hot water separation of tar sands wherein comminuted tar sand is slurried in hot water, subject to gravity separation to isolate a bituminous froth, containing water and mineral matter, and the bituminous froth is diluted with a liquid hydrocarbon solvent and subject to a two-stage centrifugation to recover the substanitally water and mineral-free bitumen. In this improved process, the dilution of bituminous froth with liquid hydrocarbon solvent is staged such that no more than about 90% of the total hydrocarbon solvent is added to the bituminous froth prior to the first centrifuging stage and the remaining hydrocarbon solvent is added prior to the second centrifuging stage.

9 Claims, 1 Drawing Figure

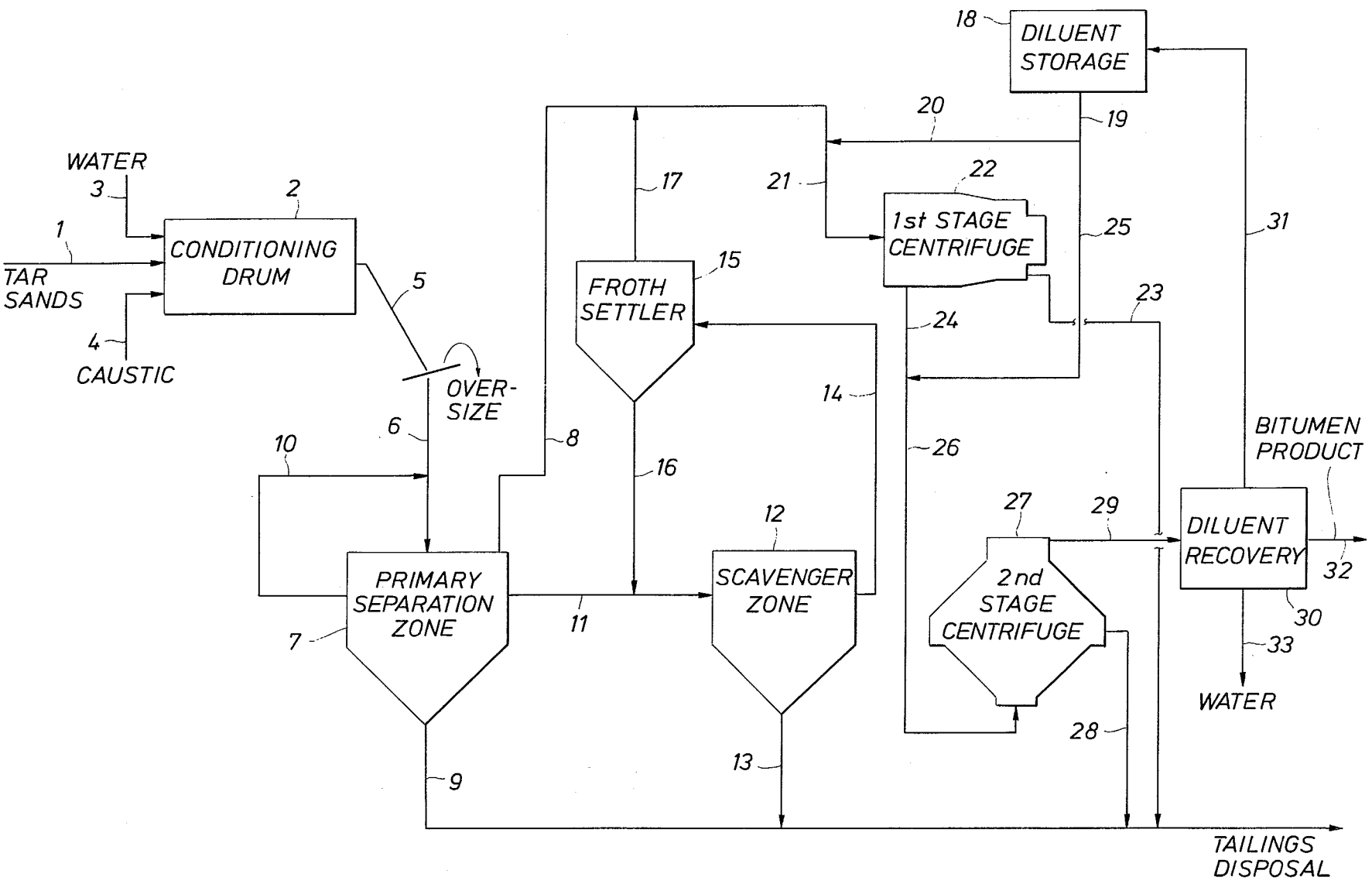
BITUMEN PRODUCT
32
30
DILUENT RECOVERY
33
WATER
TAILINGS DISPOSAL
31
23
DILUENT STORAGE
19
25
29
28
2nd STAGE CENTRIFUGE
27
18
22
1st STAGE CENTRIFUGE
20
24
26
14
21
SCAVENGER ZONE
12
13
15
FROTH SETTLER
17
16
11
8
OVER-SIZE
PRIMARY SEPARATION ZONE
9
5
6
CONDITIONING DRUM
2
10
7
WATER
3
1
TAR SANDS
4
CAUSTIC

PROCESS FOR RECOVERY OF BITUMEN FROM A BITUMINOUS FROTH

BACKGROUND OF THE INVENTION

This invention relates to a method for recovery of bitumen from bituminous froth produced by the hot water tar sands separation process. More particularly, this invention is directed to an improvement in the recovery of bitumen in the hot water process for separation of tar sands wherein solvent dilution and tow-stage centrifugal separation are employed to recover a purified bitumen, substantially free of water and particulate mineral matter, from the bituminous froth.

In the conventional hot water separation process for surface recovery of bitumen from mined tar sand deposits, the raw tar sand, i.e., tar sand and unwanted mineral rock from the mining operation, is jetted with steam and mulled with caustic soda and a minor amount of hot water in a slowly rotating conditioning drum. During this initial conditioning operation large rocks, typically 3/4 inch in diameter or larger, are rejected and the solid tar sand is converted to an aqueous based slurry containing a bitumen component in the form of a froth or emulsion with water, clay and silt fines at least partially entrained in the froth and sand particles. After conditioning, this pulp, which typically has a water content of 20–50 weight percent and a temperature of 170°–200° F, is mixed with additional water and transferred to gravity separation cells. There an oil-rich emulsion of bitumen, fine material and water rises to the surface as a froth which is withdrawn for further treatment. Sand settles to the bottom and is pumped as a slurry to a tailings disposal area. Between the bitumen froth at the top of the separation cell and the coarse material on the bottom is a body of "middlings" containing some mineral and bitumen.

A stream of middlings is withdrawn from the center of the separation cell. Part of the stream is recycled to dilute the screened pulp before it passes into the separation cells. The rest of the middlings stream is processed through air flotation scavenging cells. Froth from the scavenging cells is passed to a froth gravity settler. Tailings from the froth settler are recycled to extinction through the scavenger cells. The froth which overflows from the froth settler is combined with separation cell froth and passed from the gravity separation phase of the process for further treatment.

In the last phase of the conventional hot water separation process, the combined bituminous froth is diluted with a liquid hydrocarbon solvent such as naphtha to reduce its viscosity and density and the diluted bitumen is recovered from entrained water and mineral matter by a separation method, which usually involves one or more centrifuging steps or stages. Since the mineral materials present in the bituminous froth at this stage of the process vary rather widely in particle size. it is preferable to effect the centrifugal separation in stages, e.g., two or more successive stages wherein the largest mineral particles are removed first with the smaller particles being removed in the second or subsequent stages. Such a two-stage centrifugal separation process is disclosed in Canadian Patent No. 918,091, wherein the rotational speed of the centrifuges is used to control the mineral particle size removed in each centrifuging stage; the initial centrifuging being at a relatively low speed and the second at higher speeds. Alternatively, it is disclosed in U.S. Pat. No. 3,607,721 that the diluted bituminous froth can be first passed into a gravity settling zone to recover the bulk of the diluted bitumen, with the bitumen-containing sludge from the bottom of the settling zone being subject to a centrifugation step to secondarily recover bitumen and diluent therefrom. In either method, the entire liquid hydrocarbon diluent requirement is added in a single step to the bituminous froth prior to mineral and water separation such that all of the hydrocarbon diluent must pass through the entire separation scheme for recovery therefrom and reuse in the process. After centrifugation, the sludge from the centrifuges can be further processed to recover the hydrcarbon diluent and passed to a tailings disposal area. The substantially water and mineral matter-free bitumen in hydrocarbon diluent from the centrifuging stages is separated from the hydrocarbon diluent by distillation and passed as bitumen product to process facilities.

Although the hot water separation process, described above in general terms, is felt by many to be the most practical, and therefore optimum means of recovering bitumen from tar sands, the process is not devoid of problems. One problem area derives from the hydrocarbon diluent losses experienced in the final phase of the process where a liquid hydrocarbon solvent is added to the bituminous froth to assist in the separation and recovery of bitumen from entrained water and mineral matter. These diluent losses which occur primarily across the centrifuging stages, in cases where multiple stage centrifugal separation is employed, appear to be due to several factors. One source of diluent loss appears to be the energy input in the centrifuging stages which causes a certain quantity of the added diluent to emulsify with water and be lost in the sludge-containing effluent from the bitumen recovery phase of the process. Another possible source of diluent loss is the variable quantity and quality of the bituminous froth passed to the recovery phase, due to inherent variations in tar sands composition. This changing quality and quantity of bituminous froth causes upsets in the bitumen to diluent ratio which, in turn, may tend to overload or otherwise upset the operation of the centrifuging stages of the process thereby allowing diluent (and bitumen) to be lost in the sludge effluent. Further, the fact that a certain quantity of diluent will necessarily be lost in the first centrifuging stage by, for example, emulsification with water, forces a higher diluent to bitumen ratio than may actually be necessary, thus accentuating this loss while, at the same time, increasing the size and/or number of centrifuges required in each stage to handle this increased volume of diluted bituminous froth. The use of higher than necessary diluent to bitumen ratios can also adversely effect downstream processing of the recovered bitumen in diluent since the size and fuel requirements of downstream fractionation facilities to recover the diluent will also be greater.

Accordingly, it would be desirable if a method could be developed for recovery of bitumen from such a diluted bituminous froth by centrifugation which would afford a high quality bitumen product without the concomitant losses of hydrocarbon diluent and associated problems heretofore encountered in prior art processes.

SUMMARY OF THE INVENTION

It has now been found that diluent losses can be reduced and a higher quality bitumen product obtained in the bitumen recovery phase of the hot water, tar sands separation process wherein bituminous froth is diluted with a liquid hydrocarbon and subject to a two-stage centrifuging, if the liquid hydrocarbon solvent is added in stagewise fashion before each centrifuging stage such that no more than 90% of the total solvent charge is added to the bituminous froth prior to the first centrifuging stage.

By staging the liquid hydrocarbon solvent dilution of the bituminous froth in the manner described, inherent diluent losses in the first stage of centrifuging are reduced since less of the total diluent requirement for bitumen recovery is passed through this centrifuging stage. Further, since less liquid hydrocarbon solvent is added to the bituminous froth prior to the first stage centrifuging, less water-hydrocarbon diluent emulsion is formed in that stage and the consequent loss of emulsified diluent in the second stage centrifuging is reduced. Finally, by staged addition of diluent to the bituminous froth, much better control over the final diluent to bitumen ratio is possible since the quality of diluent added to the diluted bituminous froth prior to second-stage centrifugation can be varied to compensate for differences in the quality and quantity of bituminous froth passed to the bitumen recovery phase of the process in continuous plant operation. Better control of the final diluent to bitumen ratio not only produces a high quality bitumen product; but also allows a smaller quantity of diluent to be used since it is unnecessary to maintain a larger than required diluent to bitumen ratio as a safety factor against variations in bituminous froth composition and feed rate which is required when diluent is added at a single point in the process. Smaller diluent volumes in the centrifuging stages lead to supplemental economic advantages in the overall process because fewer and/or smaller centrifuges are needed to purify a given volume of bitumen and less energy is required for downsteam removal of diluent from the bitumen stream.

Accordingly, the instant invention provides an improved process for recovery of bitumen from bituminous froth obtained from tar sands using the hot water separation method wherein comminuted tar sand, containing bitumen, is slurried with hot water, subject to gravity separation to isolate the bitumen in the form of a bituminous froth made up principally of a mixture of bitumen and water containing a minor amount of mineral and the bituminous froth is diluted with a liquid hydrocarbon solvent and subject to two-stage centrifugation to recover the bitumen and hydrocarbon solvent, substantially free of water and mineral matter; characterized by a staging of the liquid hydrocarbon solvent dilution of the bituminous froth such that no more than about 90% of the total hydrocarbon solvent is added to the bituminous froth prior to the first centrifuging stage and the remaining hydrocarbon solvent is added prior to the second centrifuging stage.

In another aspect of the invention, it has been found that even more substantial benefits accrue if a gravity settling zone is interposed between the two centrifuging zones at a point prior to the second diluent addition. This gravity settling zone which is sized sufficiently large to give the diluted bituminous froth from the first stage centrifuging at least a 15 minute residence time, also functions as a surge zone to further facilitate uniform flow of diluted bitumen to the second stage centrifuges and protect against upsets in upstream processing. Accordingly, the instant invention also encompasses the aforedefined improved bitumen recovery process wherein the combination gravity settling and surge zone is interposed between the two centrifuging stages.

DESCRIPTION OF THE PREFERRED EMBODIMENTS

The bituminous froths which are treatable according to the process of the invention encompass those obtained from conventional hot water separation of tar sands. Such bituminous froths include that which is known as the primary froth, obtained in initial gravity separation of the hot water-tar sands slurry, that known as the scavenger cell froth, derived from air flotation and gravity settling of middlings effluent from initial gravity separation, and the combined primary and scavenger cell froths. Since conventional operation will dictate that the primary froth and scanvenger cell froth be combined prior to bitumen recovery, it is preferable that the instant invention be carried out with this combined froth. In general, the combined bituminous froth obtained from hot water separation of tar sands, such as the Athabasca tar sands found in Canada, will typically contain from about 35 to about 80% bitumen (heavy, tar-like hydrocarbon) and about 15 to about 50% water in an emulsified or substantially emulsified form as well as a minor amount, e.g., 5–15% of entrained mineral solids. These entrained mineral solids are of variable composition and particle size being clay solids and sand particles ranging in particle size from less than 1 micron up to greater than 500 microns. The rather broad range of particle sizes which characterize the mineral solids present in the bituminous froth is one of the principal reasons why multiple stage centrifuging, e.g., two-stage centrifuging, is desirable in the bitumen separation phase of the process since it is very difficult, if not impossible, to completely separate all such particle sizes in a single-stage centrifugation.

The liquid hydrocarbon solvent used to dilute the bituminous froth in the process of the invention is rather conventional in nature, it only being required that the solvent be substantially non-miscible with water and be sufficiently volatile to be readily recoverable from the bitumen by distillation. Preferably, the hydrocarbon solvent should not be so volatile that it presents a potential safety hazard in the process. Suitable liquid hydrocarbon solvents include those boiling in the 200° to 600° F range such as naphthas, kerosenes, gas oils, light cycle oils and other intermediate refinery fractions. Preferably the liquid hydrocarbon solvent is naphtha.

In the process according to the invention, the dilution of the bituminous froth with hydrocarbon solvent is split into two stages such that one portion of solvent is added to the bituminous froth prior to the first stage centrifuging and the second or remaining portion of solvent is added to the diluted bituminous froth product of first stage centrifuging before it is passed into the second stage centrifugal separation. To obtain the substantial advantages attributable to staged addition of diluent according to the invention, the flow of solvent to the process is split such that no more than 90% of the total solvent charged is added to the bituminous froth prior to first stage centrifuging with the balance of the solvent being added prior to second stage centrifuging. Preferably, this solvent charge is divided such that between about 75 and about 85% of the total solvent employed is added to the bituminous froth prior to first stage centrifuging. by dividing the solvent flow in this preferred manner, adequate viscosity reduction and separation of larger mineral particles is assured in the first centrifuging stage while at the same time minimizing solvent losses through the centrifuging process. In this regard, it is desirable to control the total diluent charge to the process at a diluent to bitumen ratio of from about 0.5 to about 1.5 with ratios in the range of 0.6 to 1.0 being preferred. At these diluent to bitumen ratios, the diluted bituminous froth charge to the first centrifuging stage generally contains about 10 to 40% water and about 3 to 12% mineral solids with the remainder being diluent bitumen. After first stage centrifuging, the mineral content of the diluted bitumen product is reduced to about 1 to about 7%, with the balance of the diluent being added to this product to make up the final diluent to bitumen ratio prior to second stage centrifuging. Second stage centrifuging yields a purified bitumen in hydrocarbon solvent which is substantially free of water and mineral matter, e.g., 5 and 0.5% water and mineral, respectively.

The technique employed to add the liquid hydrocarbon diluent to the bitumen-containing stream in the process flow scheme is wholly conventional. The diluent is quite suitably added to the process flow by means of mixing "Tees" located in the bituminous froth inlet line to the first stage centrifuges and in the diluted froth inlet line to the second stage centrifuges. The flow of diluent to the desired points in the process is suitably from a common source, e.g., diluent storage tank, with the diluent flow being controlled and divided by a conventional device such as a flow ratio controller which is instrumented to respond to changes in the bituminous froth feed rate and composition.

The centrifugal separation means employed in the instant invention is quite conventional, being the two-stage centrifugal separation technique previously described in, for example, Canadian Patent No. 918,091, which is herewith incorporated by reference. In this two-stage centrifugation, the water and mineral matter separation is staged according to the particle size of mineral matter removed with the bulk of the larger mineral particles being removed in the first centrifuging stage at lower speeds and the remaining finely-divided mineral particles being separated at high speeds in the second centrifuging stage. In the application of this technique on a practical scale, it is preferred to employ solid bowl centrifuges such as is described in John H. Perry, Chemical Engineers' Handbook, 4th ed. (1963) at page 21–55, in the first stage centrifuging. These solid bowl centrifuges are suitably equipped with a scroll conveyor for removal of solids-containing sludge and include those available commercially from the Bird Machine Company. The second stage centrifuging is suitably carried out with centrifuges adapted for higher rotational speeds such as the nozzle-discharge centrifuges described in U.S. Pat. No. 2,917,230 and pages 19–89 to 19–90 of the aforementioned Chemical Engineers' Handbook. A very suitable centrifuge for this second stage separation is the nozzle bowl, disc-type centrifuge available commercially from the Westfalia Separator A.G. Since the particulars of this two-stage centrifuging technique are known from the aforementioned Canadian patent 918,091, they need not be further detailed herein.

As mentioned previously, a preferred aspect of the instant invention involves the insertion of a gravity settling zone between the two centrifuging stages at a point in the process flow scheme prior to second stage dilution of the bitumen-containing stream. In this preferred embodiment, the diluted bituminous froth from the first stage centrifugation, having a portion of the mineral solids and water removed, is passed into a gravity settling zone which is sized sufficiently large to give the diluted bituminous froth at least a 15 minute residence time prior to the passage to the second stage centrifuging. By employing a settling zone of this size, a dual purpose is served since the settling zone also functions as a surge zone or reservoir to handle upsets or variations in bituminous froth flow from first stage centrifuging and to maintain a relatively constant flow to second stage centrifuging despite any upstream flow variations or upsets. This, of course, is of advantage because it allows closer control of the final diluent to bitumen ratio in the second centrifuging stage since the surge capacity of the settling zone acts as a buffer zone to any rapid changes in bituminous froth flow rate and composition from first stage centrifuging, thereby affording a more constant bituminous froth flow to the second stage centrifuge. Further, the surge capacity of the settling zone provides a certain amount of lead time in which changes can be made in the volume of diluent added before second stage centrifuging in the event of upsets in upstream processing. To accomplish this dual objective, it is preferred that the settling zone, suitably in the form of a large volume tank, be sized such that the residence time of the diluted bituminous froth from first stage centrifuging be from about 15 to about 60 minutes. Residence times in this preferred range give adequate settling times and surge capacities without causing the settling zone size to be prohibitively large. The heavy phase which separates from the diluted bituminous froth in this settling zone by gravity is predominantly water, generally being only a minor portion, e.g., about 5% or less, of the total water contained in the bituminous froth passed to the bitumen recovery phase of the process. This water-containing phase is withdrawn from the bottom of the settling zone at a controlled rate for disposal or reuse in the process and the bitumen-containing phase is withdrawn at a point above the water-bitumen interface and passed to second stage centrifuging. Control of the discharge rate for each phase is suitably provided in this case by an interface sensing device operatively connected to control valves on the settling zone outlet lines such that the water-diluted bitumen interface is maintained between the two outlets.

The invention will now be further described by reference to the Figure showing a schematic embodiment of the hot water tar sands separation process incorporating the improvement according to the invention.

In the embodiment shown, mined tar sands are introduced by line 1 into a conditioning drum, 2, along with controlled amounts of water, partially in the form of steam and caustic via lines 3 and 4, respectively. In this conditioning drum, 2, which is suitably a rotating cylindrical drum-type muller, the tar sands are comminuted and pulped to produce an aqueous slurry of bitumen and mineral having a water content of between about 20 and about 50% by weight of the mulled mixture and a solids particle size substantially below ½ inch. This slurry which leaves the conditioning drum by line 5 at a temperature of between about 170° and 200° F is passed through a screening step for reinjection of oversize and then into the primary separation zone, 7, via line 6. If desired, additional water can be added to the slurry in line 6 (not shown) before it enters the separation zone, 7, since best results are obtained in that zone when the water content of the slurry is between 40 and 60% by weight.

In the primary separation cell, 7, the aqueous tar sands slurry is held as a rather quiescent mass under light agitation so that bitumen rises to the upper surface of the slurry in the form of a bituminous froth while sand is allowed to settle to the bottom of the cell. Between the top bituminous froth layer and the bottom sand tailings layer in this cell, finely-divided silt and clay along with a certain amount of unseparated bitumen remain suspended in an aqueous middlings layer. The bituminous froth which collects at the top of the separation cell, 7, is withdrawn by line 8 and passed to the first stage centrifuge, 21, for recovery of the bitumen contained therein (see below). The sand tailings are withdrawn from the bottom of the separation cell, 7, via line 9 and passed to disposal, suitably in a tailings pond. One portion of the middlings layer is withdrawn via line 10 and recycled to the slurry feed line, 6, for the separation cell to aid in controlling the density and composition of incoming slurry, while the remaining portion of the middlings layer is withdrawn via line 11 and passed to the scavenger zone, 12, for separation of the bitumen contained therein. In the scavenger zone, 12, which is suitably a plurality of conventional air flotation devices, the middlings stream is subject to controlled aeration and agitation such that a dispersion of small air bubbles rises through the middlings mass causing additional bituminous froth to form as a top layer. The bottom portion of the aerated middlings in the scavenger zone, being substantially free of bituminous matter is passed by lines 13 and 9 to tailings disposal. The bituminous froth which collects as a top layer is separated by suitable means, e.g., skimmer device, from the bulk of the middlings and passed by line 14 to the froth settler, 15. In this froth settler, 15, the bituminous froth from the scavenger zone sediments into a lower layer containing settler tailings which is passed via line 16 to line 11 for recycle to the scavenger cell and an upper layer of bitumen-rich froth. This bitumen-rich froth is withdrawn from the froth settler via line 17 and combined with a bituminous froth from the primary separation zone in line 8. This combined bituminous froth typically contains 35 to 80% bitumen, 15 to 50% water and 5 to 15% solid mineral matter in the form of particulate fines.

To effect bitumen recovery from the combined bituminous froth in line 18, a first portion of naphtha diluent from diluent storage, 18, is passed via lines 19 and 20 to a mixing Tee in line 8 and combined with the bituminous froth to afford a diluted bituminous froth having the desired initial diluent to bitumen ratio (typically 0.5 to 0.9). This diluted bituminous froth is then passed via line 21 to the first stage centrifuging, 22, typically a bank of solid bowl centrifuges, wherein the bulk of the larger mineral particles and a portion of the water is removed via line 23 and passed to disposal after optional recovery of any diluent contained therein (not shown). The partially water and mineral-free bituminous effluent from this first stage centrifuging is withdrawn via line 24 and combined with a second portion of naphtha diluent passed from diluent storage via lines 19 and 25 in a second mixing Tee. This second portion of diluent which generally comprises at least 10% of the total diluent added brings the diluent to bitumen ratio of the diluted froth up to the desired final diluent to bitumen ratio (generally 0.6 to 1.0). After final dilution in this second mixing Tee, the diluted bituminous froth is passed via line 26 into the second stage centrifuging, 27, typically a bank of nozzle bowl disc-type centrifuges and essentially all of the remaining entrained water and mineral matter is removed via line 28 for disposal after optional recovery of the diluent contained therein (not shown). The purified bitumen in naphtha diluent, now essentially free of water and entrained mineral matter, is passed by line 29 to diluent recovery, 30, wherein the naphtha is fractionated overhead for recycle via line 31 to diluent storage and the purified bitumen product is removed by line 32 for further processing. Any minor amount of water still remaining in the purified bitumen is also removed in this diluent recovery zone via line 33.

What is claimed is:

1. In the process for recovery of bitumen from bituminous froth obtained from tar sands using the hot water separation method wherein comminuted tar sand containing bitumen is slurried with hot water, subjected to gravity separation to isolate the bitumen in the form of a bituminous froth, made up principally of a mixture of bitumen and water containing a minor amount of mineral matter, and the bituminous froth is diluted with a liquid hydrocarbon solvent and subjected to two-stage centrifugation to recover the bitumen and hydrocarbon solvent substantially free of water and mineral matter; the improvement which comprises; staging the liquid hydrocarbon solvent dilution of the bituminous froth such that no more than about 90% of the total hydrocarbon solvent is added to the bituminous froth prior to the first centrifuging stage and the remaining hydrocarbon solvent is added prior to the second centrifuging stage.

2. The process according to claim 1, wherein the liquid hydrocarbon solvent diluent is a liquid hydrocarbon solvent boiling in the range of 200° to 600° F.

3. The process according to claim 2, wherein the liquid hydrocarbon solvent is selected from the class consisting of naphthas, kerosene, gas oils and light cycle oils.

4. The process according to claim 3, wherein the liquid hydrocarbon solvent is naphtha.

5. The process according to claim 2, wherein between about 75 and about 85% of the total hydrocarbon solvent charge is added to the bituminous froth prior to first stage centrifuging.

6. the process according to claim 2, wherein the total hydrocarbon solvent diluent charge to the process is controlled to yield an overall diluent to bitumen ratio in the process of about 0.5 to about 1.5.

7. The process according to claim 6, wherein the diluent to bitumen ratio is in the range of 0.6 to 1.0.

8. The process according to claim 1, wherein the diluted bituminous froth from the first stage centrifuging is passed into a gravity settling zone for removal of a portion of the water and mineral matter contained therein as heavy phase bottoms product with the bitumen and hydrocarbon solvent-containing upper phase being passed to second stage centrifuging, said gravity settling zone being sized sufficiently large to give the diluted bituminous froth at least a 15 minute residence time.

9. The process according to claim 8, wherein the residence time of the diluted bituminous froth from first stage centrifuging in the gravity settling zone is between about 15 and about 60 minutes.

* * * * *